US008028639B2

(12) United States Patent
Rodger

(10) Patent No.: US 8,028,639 B2
(45) Date of Patent: Oct. 4, 2011

(54) TRANSOM FOR BOAT

(76) Inventor: Kenneth J. Rodger, Parshall, CO (US)

( * ) Notice: Subject to any disclaimer, the term of this patent is extended or adjusted under 35 U.S.C. 154(b) by 0 days.

(21) Appl. No.: 12/235,131

(22) Filed: Sep. 22, 2008

(65) Prior Publication Data

US 2009/0078187 A1 Mar. 26, 2009

Related U.S. Application Data

(60) Provisional application No. 60/974,420, filed on Sep. 21, 2007.

(51) Int. Cl.
*B63B 5/24* (2006.01)

(52) U.S. Cl. ..... 114/357; 114/355

(58) Field of Classification Search ..... 114/65 R, 114/77 A, 77 R, 355, 357; 181/290, 294
See application file for complete search history.

(56) References Cited

U.S. PATENT DOCUMENTS 3,399,103 A * 8/1968 Salyer et al. ..... 114/355
3,613,137 A 10/1971 Eccles
4,739,722 A * 4/1988 Rogstad ..... 114/357
5,036,788 A 8/1991 Unger
5,277,145 A * 1/1994 Hordis ..... 114/357
5,372,763 A 12/1994 Hordis
5,617,808 A 4/1997 Robinson
7,341,016 B2 * 3/2008 Terleski et al. ..... 114/343
7,448,780 B2 * 11/2008 Hurley ..... 362/477
7,520,644 B2 * 4/2009 Jordan et al. ..... 362/477
2002/0070074 A1 * 6/2002 Bongiovi, Jr. ..... 181/207
2007/0201238 A1 8/2007 Hurley

* cited by examiner

*Primary Examiner* — Lars A Olson
(74) *Attorney, Agent, or Firm* — Buskop Law Group, PC; Wendy Buskop

(57) ABSTRACT

A tuned transom for a marine vessel comprising a boat hull having a bow and an aft section, a port side and starboard side with a centerline. The transom comprises an outer constraining layer positioned in the aft section enclosing the boat hull, an inner constraining layer which is a separate sheet from the outer constraining layer and positioned in the hull spaced-apart forwardly from the outer constraining layer to form a space between the inner constraining layer and the outer constraining layer, an a constrained damping layer adapted to bond the outer constraining layer to the inner constraining layer; wherein the constrained damping layer comprises an adhesive and means for securing the edges of the outer and the inner constraining layers to the hull.

12 Claims, 1 Drawing Sheet

TRANSOM FOR BOAT

CROSS REFERENCE TO RELATED APPLICATIONS

The present application claims priority to co-pending U.S. Provisional Patent Application Ser. No. 60/974,420 filed on Sep. 21, 2007; entitled: "Transom for Boat" and is incorporated herein.

FIELD

The present embodiments relate to a tuned transom for a boat which can be sold as a kit for retrofitting hulls or can be sold as a part and installed on new boats, particularly boats using outboard motors, inboard-outboard motors, or inboard-outboards with forward facing counter rotating propellers.

BACKGROUND

A need exists for a transom which provides sound damping characteristics to a user of a vessel, such as park rangers using a boat to study endangered wildlife, like the Manatee in the springs of Florida.

A need exists for a transom which provides recreational boaters, such as fisherman, pleasure boaters, or people working on boats, a quiet sound damped experience. That enhances the enjoy ability of the boating experience and reduces human fatigue.

A further need exists for a kit that enables an existing boat owner to retrofit a hull to recycle a hull that is otherwise noisy or too high in vibration transmission into one that transfers fewer motor vibrations from the motor to the driver, enabling fishermen to use existing boats for a longer period of time.

The present embodiments meet these needs.

BRIEF DESCRIPTION OF THE DRAWINGS

The detailed description will be better understood in conjunction with the accompanying drawings as follows.

Figure 1:
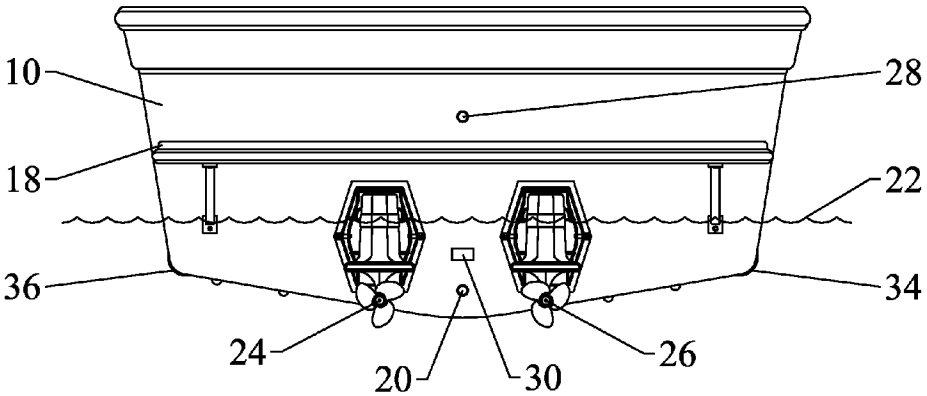
FIG. 1 shows a perspective view of the transom according to the embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a tuned transom for a marine vessel comprising a boat hull having a bow, an aft section, a port side and starboard side with a centerline. The present embodiments further relate to a support system for an outboard motor for a marine vessel.

The support structure is a transom of a marine vessel. The marine vessel can be a jon boat, a fishing boat, a row boat, an inflatable boat, a patrol boat, a motor boat, a speed boat, a center console offshore fishing boat, a high performance race boat, an additional vessel, or combinations thereof.

The support structure can be used on marine vessels with at least one outboard engine or with one or more I/O engines, that is, one or more inboard-outboard engines mounted through a transom, or an axis drive engine.

An embodiment of the invention is to provide improved transoms which are light weight with sound damping for providing reduced operator fatigue resulting in a more enjoyable boating experience. As boat hulls get lighter and stiffer, the resonant frequency is shifted into a higher frequency range more in line with human speech interference.

Reduced fatigue would help the operators of high speed boats such as US Customs boats used to intercept drug trafficking and needing stealth approaches. The operators would become less tired, stressed and strained during pursuits, without the need for loud communications to be projected over the noise.

Another embodiment of the invention is to improve increased control over self-generated noise on-board, reducing pick up of a hull signature of a marine vessel by nearby hydrophones or acoustic sensors.

The embodiments contemplate that the marine vessel can have a boat hull with a bow, an aft section, a port and starboard side with a centerline or a vertical plane of symmetry which divides the marine vessel into port and starboard portions, and a transom. The transom can be perpendicular to the plane of symmetry of the marine vessel. The transom can be constructed, as in the case of certain sailboats, to have a slight angle that is greater than 90 degrees from the plane of the keel of the marine vessel. This angle of the transom could range between about 80 degrees and about 100 degrees from the keel.

The motor that can be mounted on or through the transom can be one or more outboard motors, wherein each motor has a plurality of mounts for securing, removably to the transom. The transom can be contemplated for use with removable and nonremovable transom mounted motors. The mounts provide the connection for translating the motor vibrations from the motor to the transom and the hull and into the surrounding water causing environmental issues. In an additional embodiment, the transom can be non-movable and fixedly secured to the hull.

In another embodiment, the transom can be removably secured to the hull by sliding the tuned transom into rail guides mounted to the hull, and wherein the rail guides can further comprise a plurality of gaskets for insuring a watertight seal between the transom and the hull. This embodiment can be particularly useful for use with folding canoes or folding marine vessels which are lightweight and can be carried by one person, weighing between about 25 pounds to about 65 pounds and supporting at least a trolling motor.

Additionally, one or more fasteners can be used to secure the removable transom to the hull. These fasteners can be L-shaped flanges that can be locked into place using D-shaped mounting brackets.

The tuned transom in another embodiment can have one or more drains disposed through the hull using either one way valves or drain plugs to prevent water from re-entering the hull. The tuned transom in still another embodiment can support a swim platform mounted to an outer constraining layer or through all layers of the transom.

In another embodiment, the transom can support at least one or more shaded underwater lights for use in viewing marine mammals.

In still another embodiment, the transom can include trim apparatus, such as non-skid chines or other projections which can be used to stabilize the vessel during turns. A stabilized vessel provides less turbulence to the water during turns, preventing or at least minimizing disturbances to endangered wildlife.

The tuned transom can also be used to support stereos and speaker systems enabling the users to have a more enjoyable ride with less vibration.

The embodied transom can have an outer constraining layer positioned in the aft section enclosing the boat hull. The outer constraining layer can be made of plywood, aluminum, a laminate of aluminum over wood, a structural foam, or combinations thereof.

An inner constraining layer can be a separate sheet spaced from the outer constraining layer and positioned in the hull spaced-apart forwardly from the outer constraining layer. The inner constraining layer can be made for the same materials as the outer constraining layer, such as plywood, aluminum, a laminate of aluminum over wood, a structural foam, or combinations thereof.

A constrained damping layer can be used to bond the outer constraining layer to the inner constraining layer. The constrained damping layer can comprise an adhesive and has the characteristics of being non-brittle and a visco elastic material. The constrained damping layer does not provide a structural glue line, with the exception of one embodiment of the invention, a structural cork rubber blend known as CDM/ACM 17™ made by Amorim Industrial Solutions of Trevos, Wis., which uses two layers, one on either side of the structural cork rubber blend of a structural adhesive known as Isoset Adhesive.

Additionally, the transom can include means for securing the edges of the outer and the inner constraining layers to the hull. This means can be the same resin blending, which can be a epoxy fiberglass curable resin mixture, used to hold the rest of the vessel together. In another embodiment the transom can be stapled, bolted, screwed, or combinations thereof to the hull.

The outer constraining layer can be made from plywood, aluminum, a laminate of aluminum over wood, or an encapsulated structural foam, such as those known as Coosa™ made by Coosa Company, Spaceage™ made by Spaceage Company or Penske™ made by the Penske Company.

The inner constraining layer can be made from the same material as the outer constraining layer. The outer constraining layer and inner constraining layer can further comprise an encapsulated plywood.

In an embodiment, the constrained damping layer can comprise a visco elastic non adhesive material and at least one layer of structural adhesive.

In an embodiment, if the hull was made from two 1.5 inch thick layers of encapsulated plywood, then the transom outer and inner constraining layers can be made of the same material.

Similarly, if a 1.5 inch rigid polyurethane was used for reinforcement with Penske or Coosa material used to form the hull of the vessel, an identical thickness of the same material would be used for the outer constraining layer of the transom in at least one embodiment.

An embodiment of the invention maintains the outer constraining layer at a thickness larger than the thickness of the inner constraining layer, enabling the pair of layers to have an asymmetry relationship so long as that asymmetrical ratio does not exceed a ratio of 4:1.

In an embodiment, the transom can be secured to the boat hull by means identical to the means used to connect the seams of the hull together in other portions of the hull.

It is contemplated that the constrained damping layer can be between about 0.003 inches to about 0.1 inches thick.

The constraining layers can have a thickness between about ¾ of an inch to about 3 inches.

The embodiments also relate to a kit wherein the transom made of the multiple layers with a visco elastic layer can be applied to an existing transom using an adhesive layer with a release layer, so that a fisherman can use a boat with a rotting transom and create a longer lasting boat that translates fewer motor vibrations from the transom to the operator.

Other materials that can be used as the visco elastic layer include a liquid emulsion known as Flex-Cryl 1625™ made by Air Products and Chemical Inc. of Allentown, Pa., which is applied wet in a layer and then positioned between the layers and pressed until dry. Another visco elastic material that can be used as the constrained damping layer is Adchem 730 made by Adchem, Inc, of Riverhead, N.Y., which is pressure sensitive material applied to each of the two constraining layers. Another visco elastic material that can be used as the constrained damping layer is PDP manufactured by American Acoustical Products in Holliston Mass.

Turning now to the Figures, FIG. 1 shows a perspective view of an embodiment the transom 10 having a swim platform 18 secured above the waterline 22. A first drain hole 20 below the waterline for allowing bilge water to drain out the vessel and a second drain hole 28 above the waterline allowing water to drain from the cockpit.

This embodiment further shows the transom supporting two inboard-outboard drives, the first I/O 24 and the second I/O 26. An underwater light 30 can be located below the waterline 22. A first non-skid chine 34 can be attached to one side of the transom where it meets the hull, and a second non-skid chine 36 can be attached to the other side of the transom.

Figure 2:
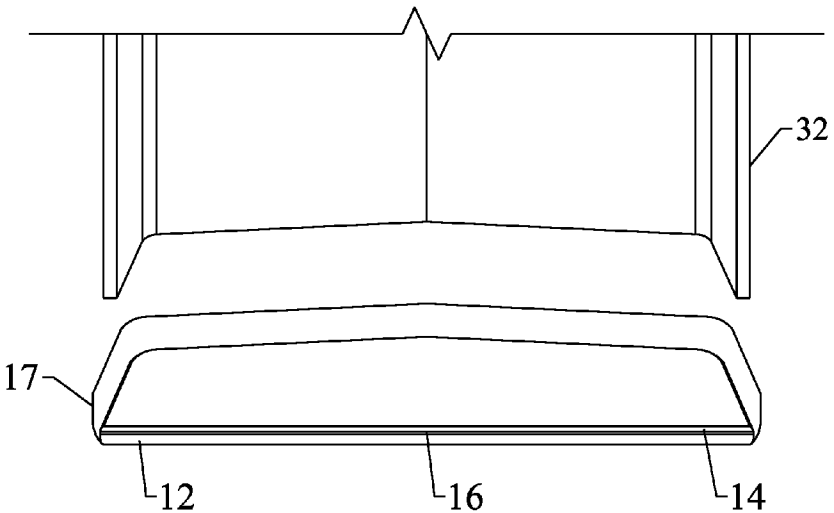
FIG. 2 shows a top view of an embodiment of the transom depicting the inner constraining layer, the outer constraining layer and the visco elastic damping layer.

FIG. 2 shows a top view of an embodiment of the transom 10 revealing the inner constraining layer 14 being thinner than the outer constraining layer 12, a visco elastic constrained damping layer 16 that is thinner than the outer constraining layer and an inner constraining layer. The multilayer material is connected to the hull 32 with a material such as an adhesive 17 or other material that can be used with the hull.

While these embodiments have been described with emphasis on the embodiments, it should be understood that within the scope of the appended claims, the embodiments might be practiced other than as specifically described herein.

What is claimed is:

1. A tuned transom for a marine vessel comprising a boat hull having a bow, an aft section, a port side and starboard side with a centerline, wherein the tuned transom comprises:

a. an outer constraining layer positioned in the aft section enclosing the boat hull;

b. an inner constraining layer that is a separate sheet from the outer constraining layer and parallel to the outer constraining layer;

c. a constrained damping layer adapted to bond the outer constraining layer to the inner constraining layer, wherein the constrained damping layer consists of a visco elastic material, wherein the visco elastic material does not provide a structural glue line, wherein the constrained damping layer is thinner than the outer constraining layer and the inner constraining layer at a ratio of no more than 4:1; and d. means for securing edges of the outer constraining layer and the inner constraining layer to the boat hull.

2. The tuned transom for a marine vessel of claim 1, wherein the outer constraining layer is plywood, aluminum, a laminate of aluminum over wood, or a structural foam.

3. The tuned transom for a marine vessel of claim 2, wherein the inner constraining layer is made from the same material as the outer constraining layer.

4. The tuned transom for a marine vessel of claim 1, wherein the means for securing the edges of the outer constraining layer and the inner constraining layer is identical to means used to connect seams of the boat hull together in other portions of the boat hull.

5. The tuned transom for a marine vessel of claim 1, wherein the marine vessel is a jon boat, a fishing boat, a row boat, an inflatable boat, a patrol boat, a motor boat, a speed boat, a center console offshore fishing boat, a high performance race boat, an additional vessel, or combinations thereof.

6. The tuned transom for a marine vessel of claim 1, wherein the tuned transom is used to support at least one outboard motor, at least one inboard-outboard motor or at least one axis drive engine.

7. The tuned transom for a marine vessel of claim 1, wherein the tuned transom comprises one or more drains.

8. The tuned transom for a marine vessel of claim 1, wherein the tuned transom supports at least one underwater light.

9. The tuned transom for a marine vessel of claim 1, wherein the tuned transom further comprises a trim apparatus to prevent skidding of the marine vessel during turns.

10. The tuned transom for a marine vessel of claim 1, further comprising a swim platform connected to the outer constraining layer.

11. The tuned transom for a marine vessel of claim 1, wherein the means for securing is an epoxy fiberglass curable resin mixture.

12. The tuned transom for a marine vessel claim 1, wherein the boat hull comprises the outer constraining layer and the inner constraining layer, which further comprises an encapsulated plywood.

* * * * *